US009221652B2

(12) United States Patent
Skowronski

(10) Patent No.: US 9,221,652 B2
(45) Date of Patent: Dec. 29, 2015

(54) ROTATABLE CABLE GUIDE FOR RETRACTABLE CORD REEL

(71) Applicant: Response Engineering, Inc., North Hampton, NH (US)

(72) Inventor: Richard Skowronski, North Hampton, NH (US)

(73) Assignee: Response Engineering, Inc., North Hampton, NH (US)

( * ) Notice: Subject to any disclaimer, the term of this patent is extended or adjusted under 35 U.S.C. 154(b) by 331 days.

(21) Appl. No.: 13/947,460

(22) Filed: Jul. 22, 2013

(65) Prior Publication Data

US 2014/0263801 A1 Sep. 18, 2014

Related U.S. Application Data

(60) Provisional application No. 61/852,580, filed on Mar. 18, 2013.

(51) Int. Cl.
*B65H 75/00* (2006.01)
*B65H 75/44* (2006.01)

(52) U.S. Cl.
CPC ..... *B65H 75/4449* (2013.01); *B65H 2701/34* (2013.01)

(58) Field of Classification Search
CPC ..... B65H 75/44; B65H 75/4423; B65H 75/4434; B65H 75/4449; B65H 75/14; B65H 75/4418; B65H 75/4402; B65H 2701/34
See application file for complete search history.

(56) References Cited

U.S. PATENT DOCUMENTS

| | | | | |
|---|---|---|---|---|
| 3,657,491 | A * | 4/1972 | Ryder et al. | 191/12.2 R |
| 4,989,805 | A * | 2/1991 | Burke | 242/378.2 |
| 5,094,396 | A * | 3/1992 | Burke | 242/378.2 |
| 5,332,171 | A * | 7/1994 | Steff | 242/378 |
| 5,535,960 | A * | 7/1996 | Skowronski et al. | 242/378.4 |
| 5,718,310 | A * | 2/1998 | Gallo | 191/12.2 R |
| 6,372,988 | B1 | 4/2002 | Burke et al. | |
| 6,416,005 | B1 * | 7/2002 | Liao | 242/378.1 |
| 6,439,491 | B1 * | 8/2002 | Liao | 242/378.1 |
| 6,474,585 | B2 * | 11/2002 | Liao | 242/378.1 |
| 6,808,138 | B2 * | 10/2004 | Liao | 242/378.1 |
| 7,017,846 | B2 * | 3/2006 | Tsoi et al. | 242/378.2 |
| 7,108,216 | B2 * | 9/2006 | Burke et al. | 242/378.1 |
| 7,172,150 | B1 * | 2/2007 | Hutchison et al. | 242/375.2 |
| 7,216,665 | B1 * | 5/2007 | Sims, Jr. | 137/355.19 |
| 7,222,811 | B2 * | 5/2007 | Chang | 242/378.1 |
| 7,364,109 | B2 * | 4/2008 | Kuo | 242/373 |
| 7,665,684 | B2 * | 2/2010 | Salentine et al. | 242/379.2 |
| 8,123,010 | B2 * | 2/2012 | Skowronski et al. | 191/12.2 R |
| 8,387,763 | B2 | 3/2013 | Burke et al. | |
| 2004/0200920 | A1 * | 10/2004 | Wei | 242/378.4 |
| 2006/0006038 | A1 * | 1/2006 | Beverlin | 191/12.2 R |
| 2006/0186248 | A1 * | 8/2006 | Liao | 242/378 |
| 2012/0126047 | A1 * | 5/2012 | Skowronski et al. | 242/388.6 |
| 2014/0263801 | A1 * | 9/2014 | Skowronski | 242/397.5 |

* cited by examiner

*Primary Examiner* — Jason C Smith
(74) *Attorney, Agent, or Firm* — Fleit Gibbons Gutman Bongini & Bianco PL; Jon A. Gibbons

(57) ABSTRACT

A novel retractable cord reel is disclosed. The retractable cord reel may have a rotating rotatable guide configured to adapt to an expandable wire coil that changes direction within the cord reel. The retractable cord reel may have splices between wire segments that are formed by electrical connectors that are sealed from the environment with an adhesive.

23 Claims, 10 Drawing Sheets

ROTATABLE CABLE GUIDE FOR RETRACTABLE CORD REEL

CROSS-REFERENCE TO RELATED APPLICATIONS

This application is a continuation-in-part of and claims priority from prior U.S. Provisional Patent Application No. U.S. 61/852,580, filed on Mar. 18, 2013, the entire disclosure of which application is incorporated by reference in its entirety.

FIELD OF THE INVENTION

The present invention relates generally to a retractable cord reel apparatus, and more specifically relates to a retractable cord reel with wire or cable management.

BACKGROUND OF THE INVENTION

Retractable cord reels have been used in various applications to retractably store various types of wires, cords and cables. Typically, a reel might have a stationary end and a retractable end. The retractable end is typically wound on a rotating spool within the cord reel which carries a wire or cable capable of extension from and retraction back into the reel as the cord is unwound from then rewound back onto the rotating spool. The stationary end does not move during extension or retraction. Such a configuration reduces the mess typically associated with loose wires, as well as dangers related to loose cords which can, for example, become damaged creating electrical hazards or get in the way such as becoming a tripping hazard.

One type of prior art cord reel uses electrical contacts to achieve electrical continuity between the retractable cord carried on the rotating spool and the stationary cord which is typically attached to the stationary cord reel housing. These electrical contacts can slide as in common brush and slip ring type cord reels, or they can provide contact only when the spool is locked from rotation as described in U.S. Pat. No. 8,123,010 with inventors Richard Skowronski et al. The sliding contacts in a brush and slip ring cord reel can corrode, wear out, accumulate dirt or encounter other problems that may interfere with proper conduction of electricity or electrical signals. This is particularly a problem at low voltages where electricity is unable to arc through a small gap or dirt and result in an open circuit. Cord reels such as shown in U.S. Pat. No. 8,123,010 with inventors Richard Skowronski et al, which have contacts on a ratchet that engage only when the spool is locked from rotation, avoid some of the wear and dirt accumulation issues but they do not provide continuous continuity during extension and retraction of the retractable cable. Additionally, both the brush/slip ring cord reels and the contacts-on-ratchet cord reels can potentially cause sparks as the contacts rub which can be a problem in wet or potentially explosive environments.

Another type of cord reel can maintain continuous electrical continuity between the rotating spool and the stationary housing without any moving electrical contacts. This type of cord reel instead uses a dedicated internal flat cable to connect the rotating spool with the stationary housing. The internal cable has a flat configuration and winds from a loose coil to a tight coil as the spool is rotated, and then unwinds from a tight coil to a loose coil as the spool is rotated back. The flat cable is routed from a flat cable coiling area through an axial opening in a radial wall of the spool to the spool interior and connects to a round retractable cord. Examples of this type of cord reel can be seen in U.S. Pat. No. 5,535,960 with inventors Richard Skowronski et al and U.S. Pat. No. 5,094,396 with inventor Paul C. Burke.

A variation of the internal coil type cord reel has an internal flat cable coil that begins tightly coiled when the retractable cord is fully retracted, and uncoils when the retractable cord is extended. As the internal coil becomes fully unwound, continued rotation of the spool caused by additional extension of the retractable cord causes the internal cable to flip and switch direction and begin coiling in the opposite direction. When the retractable cord reaches full extension, the internal cable is tightly wound on the center of the spool in a direction opposite the direction at full retraction. The flat cable is typically routed through an opening in the spool wall to an internal chamber inside the spool where the cable transitions from a flat to a round configuration. An example of this type of cord reel can be seen in U.S. Pat. No. 6,372,988 with inventors Paul C. Burke et al. The advantage of this type of cord reel is that for a given size coil of internal cable, the number of turns of the spool is nearly doubled, greatly increasing the length of retractable cord that can be coiled on the spool. Unfortunately these cord reels have a very short service life because the internal cable is forced to bend sharply back and forth as the retractable cord is extended and retracted, resulting in early failure of the internal cable.

A new variation of this cord reel with a flipping internal cable is described in U.S. Pat. No. 8,387,763 with inventors Paul C. Burke et al. Here a rotating aperture, also called a rotating ferrule, is mounted to the axial opening in the radial wall of the rotating spool. The rotating aperture is entirely, or nearly entirely in the flat cable expansion chamber and rotates about its own axis such that as the internal flat cable flips from one coil direction to the other, the ferrule rotates to accommodate the flipping of the flat cable. The flat cable is routed through the aperture in the rotating aperture to the interior of the spool. This rotating ferrule eliminates the sharp bending of the internal flat cable, greatly increasing service life.

SUMMARY OF THE INVENTION

The present invention relates to one or more of the following features, elements or combinations thereof.

One disclosed example is directed to improvements in a retractable cord reel of the type having a rotating spool and cord expansion chamber. The reel has a brushless connection between a retractable portion of the cord and a stationary cord end of the assembly. This connection may be facilitated using the previously disclosed retractable reel that comprises a retractable portion and an expansion portion disposed within an expansion chamber.

Such an improved cord reel may contain a rotatable guide to control the flipping of the internal flat cable. In one example, the rotatable guide includes a substantially C-shaped body with a first pivot point disposed on a first end and a second pivot point disposed on a second end. The first pivot point and the second pivot points are co-axially aligned. The substantially C-shaped body is formed to guide a flat cable to enter in a first plane and guide the flat cable to exit in a second plane that is parallel to the first plane and is perpendicular to an axis of rotation of the first and second pivots. A fastening means, such as a pin, a screw, a rivet, adhesive, a tab, a rib, or a combination thereof, may be used for holding a flat cable in the C-shaped body.

In another example, the rotatable guide comprises an elongated body with a first substantially rectangular opening formed therein and configured to be an entrance for a flat cable to pass there through. The elongated body includes a second substantially rectangular opening formed therein and configured to be an exit for the flat cable to pass therefrom. A first pivot point is disposed on a first end of the elongated body and a second pivot point disposed on a second end of the elongated body and co-axially aligned with the first pivot point. There are various configurations and orientations of the first and second substantially rectangular openings. For example, one or both of the first and second substantially rectangular openings may be generally aligned with an axis of the first pivot point and second pivot point. Also, the first and the second substantially rectangular openings may be oriented one over the other. At least one of the first and second substantially rectangular openings is generally aligned with the axis of the pivots. Moreover, the first and second rectangular openings may be located on a same side of the elongated body. Further, the first and the second substantially rectangular openings may be combined to form a single elongated opening located on a same side of the elongated body. Still further, one or both of the first and second substantially rectangular openings are substantially in a radial direction. A pluggable electrical connector may be disposed in one or both of the first and second substantially rectangular openings.

The disclosed apparatus contains, in one example, a connection chamber within which wires of the round cord configuration are connected to the flat cable. The connection may be made using standard UL recognized connectors or custom connectors. The connectors can be configured with overlapping insulation to create an environmental seal, or a sealant or adhesive can be added to the connectors to create a seal. In the alternative, the connection can be molded over with polymer to insulate and seal the connection. The resulting sealed connection resists water, dirt, vapor, solvents and other elements.

Alternatively, the rotatable guide includes an elongated body consisting of a first portion configured as an entrance for a flat cable and a second portion configured as an exit for the flat cable, at least one of the first portion and the second portion formed as a substantially rod-shaped portion. A first pivot point is disposed on a distal end of the first portion of the elongated body. A second pivot point is disposed on the distal end of a second end of the elongated body. A flange may be formed between the substantially rod shaped portion and the pivot point. The rod shaped portion may have a cross section that is one of non-circular, such as C-shaped T-shaped, X-shaped; and cross-shaped.

The rotatable guide is disposed within a retractable cord reel. The retractable cord reel includes a housing with an interior and an exterior and a spool with an axis arranged for rotation relative to the housing. The spool is axially divided into a plurality of chambers, and the spool includes a set of pivot points. The rotatable guide has an elongated body consisting of a first portion configured as an entrance for a flat cable in a first plane and a second portion configured as an exit for the flat cable in a second plane that is parallel to and offset from the first plane. A first pivot point is disposed on a first end of the elongated body. A second pivot point is disposed on a second end of the elongated body. The first and the second pivot points are co-axially aligned. The rotatable guide is rotatably mounted between the set of pivot points in the spool. A cord traverses the interior of the housing and terminates in retractable and stationary ends external to the housing.

The expansion of the flat cable within the expansion chamber may be configured to allow the flat cable to wind back around the spool in a reverse direction after expansion. This unwinding and winding reduces the length of cable needed in the expansion chamber by approximately half, thereby providing a superior product that weighs less, costs less, has less conductive resistance and dissipates less heat.

Prior art cord reels either allowed the flat cable to bend sharply or accommodate flipping of the flat cable by using a rotating ferrule, also called a rotating aperture, to guide the flipping of the cable. The rotating ferrule required that a ferrule be added to the flat cable before both ends are terminated. It also required that the flat cable be routed through the spool wall that provides bearing support of the ferrule before the cable is terminated because the hole supporting the ferrule is much too small for cable connectors or terminations to fit through. It is for this reason that the connection of flat and round cable sections in prior art cord reels be made after installing the flat cable to the cord reel spool and also the reason that the connection be potted as part of the spool, an expensive and laborious task.

Instead of a rotating ferrule mounted to the spool wall, the present invention has a rotatable guide that is independent of the spool wall. Thus, the axial opening in the radial spool wall can be made to almost any size or shape allowing pre-manufactured cable sets with molded plugs, connectors or overmolded splices to pass through. This greatly reduces cost and time of assembly and also cord sets can be properly sealed and tested prior to cord reel assembly.

The rotatable guide of the present invention extends mostly or entirely through the interconnection chamber where there is a small coil of flat cable to accommodate the rotation of the rotatable guide. This allows the rotatable guide to control the flat cable coil in the interconnection chamber so it is less likely to rub internal surfaces that might lead to thinning of the insulation due to wear. A better controlled coil is also easier and faster to install during cord reel assembly.

As opposed to a rotating aperture or ferrule, the rotatable guide has no axial aperture through which the flat cable must be routed thereby greatly improving ease of assembly and the flexibility of the cord reel to accommodate different cords, cables and cord reel designs.

The rotatable guide of the present invention is also relatively flat in shape as opposed to the mostly cylindrical ferrule. The flat shape improves the coiling of the flat cable at the center of the expansion chamber by reducing the coil diameter and softening otherwise sharp small radius bends.

The rotatable guide can also be configured with a substantially open configuration allowing it to be assembled to a flat cable after both ends are terminated with splices or connectors. This greatly improves flexibility of assembly and reduces cost compared to a ferrule that must be installed prior to termination of both ends of the cable.

Another feature of the invention is a means to axial bias the spool toward one side of the housing. Polymer materials commonly used in the manufacture of cord reels often warp and shrink resulting in dimensional variations in the parts of the cord reels. These variations must be accounted for in the design of the cord reel and require sometimes large clearances between parts to assure the parts will always fit together. These large clearances can sometimes cause moving parts to rub on cords and cables causing the insulation to wear. It is therefore desirable to have a means to remove some of the clearances after the cord reel is assembled.

Moreover, the present invention overcomes many of the disadvantages of prior art systems, especially systems using a rotating ferrule. For example, the rotating ferrule is roughly cylindrical and it increases the diameter on which the internal flat cable coils as well as causes a bump on the coiling surface that can result in additional bending and shorter cable life. The present invention is not cylindrical and the diameter on which the internal flat cable coils can be kept smaller.

In addition, since the rotating ferrule or aperture is mostly or entirely in the flat cable coiling area of the spool, it provides no guidance of the flat cable in the interior of the spool. In contrast the present invention provides guidance in the flat cable expansion area and also in the spool interior where another small expanding coil is located.

Additionally, the axial aperture in the radial spool wall in which the rotating ferrule is mounted, is sized to act as a bearing surface to control the rotation and axial movement of the ferrule. This results in a hole in the spool that is much too small to allow passage of a pre-manufactured cable and connector assembly from the flat cable expansion chamber to the interior of the spool. Because of this, the flat cable must be routed through the aperture in the rotating aperture or ferrule, and also through the axial aperture in the spool before the cable is spliced, terminated or insulated. This can become a substantial burden during the manufacturing process. The present invention enables the use of pre-manufactured cord sets. These cord sets can be quickly installed during assembly without the need for subsequent splicing, insulating and sealing. The guide of the claimed invention can also be configured such that it can be installed on a cord set after connectors are molded onto both ends of the cable or cordset.

Prior art cord reels would sometimes use a washer to take up clearance, or sometimes do nothing at all and simply accept the clearances and resulting problems. While adding washers is an acceptable solution, it is difficult to determine the appropriate washer thickness for a particular cord reel before it is completely assembled. This is a problem because the washer must be added before the cord reel is assembled, therefore disassembly and re-assembly is required in order to make an adjustment.

The present invention incorporates a means to remove excessive axial clearance of the spool, also known as endplay, after the cord reel is assembled, therefore no additional disassembly or reassembly of the cord reel is necessary. A plunger is added to the cord reel housing near the axis of the spool and presses against the spool pushing it axially to remove endplay. The plunger can be threaded so it can be turned like a screw to move it axially, or it can have a screw behind it to push it axially. A variation would be to apply a spring behind the plunger that would remove end play by means of spring force eliminating the need for manual adjustment. A variation of the spring plunger would use a portion of the power spring to drive the plunger. While the power spring biases the rotation of the spool so the retractable cord can be retracted when not in use, the spring can also be modified to provide axial force at the center of the cord reel that drives the plunger.

Still another variation would be a cord reel that uses the natural tendency of a power spring to expand axially as it is wound from rotation. Placing the power spring such that one side is in contact with the spool and the side located axially opposite bears directly or indirectly against the housing causes the power spring to push the two apart resulting in the desired axially biasing of the spool. This biasing can be enhanced by manufacturing the spring such that in its natural state the center of the spring is axially displaced from the outer diameter of the spring causing the spring to be somewhat conical. This spring can perform both the axial biasing of the spool to remove clearances without the need for a plunger, and at the same time, the rotational biasing of the spool to retract the cords.

Axial biasing can also be accomplished by configuring the flange portion of the spool to move axially and take up end play using a spring, screw or other mechanism in a manner similar to that described for the plunger above.

DETAILED DESCRIPTION

Non-Limiting Examples and Terminology

As required, detailed embodiments of the present invention are disclosed herein; however, it is to be understood that the disclosed embodiments are merely examples of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure and function. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

Overview of Retractable Cord Reel

Figure 1:
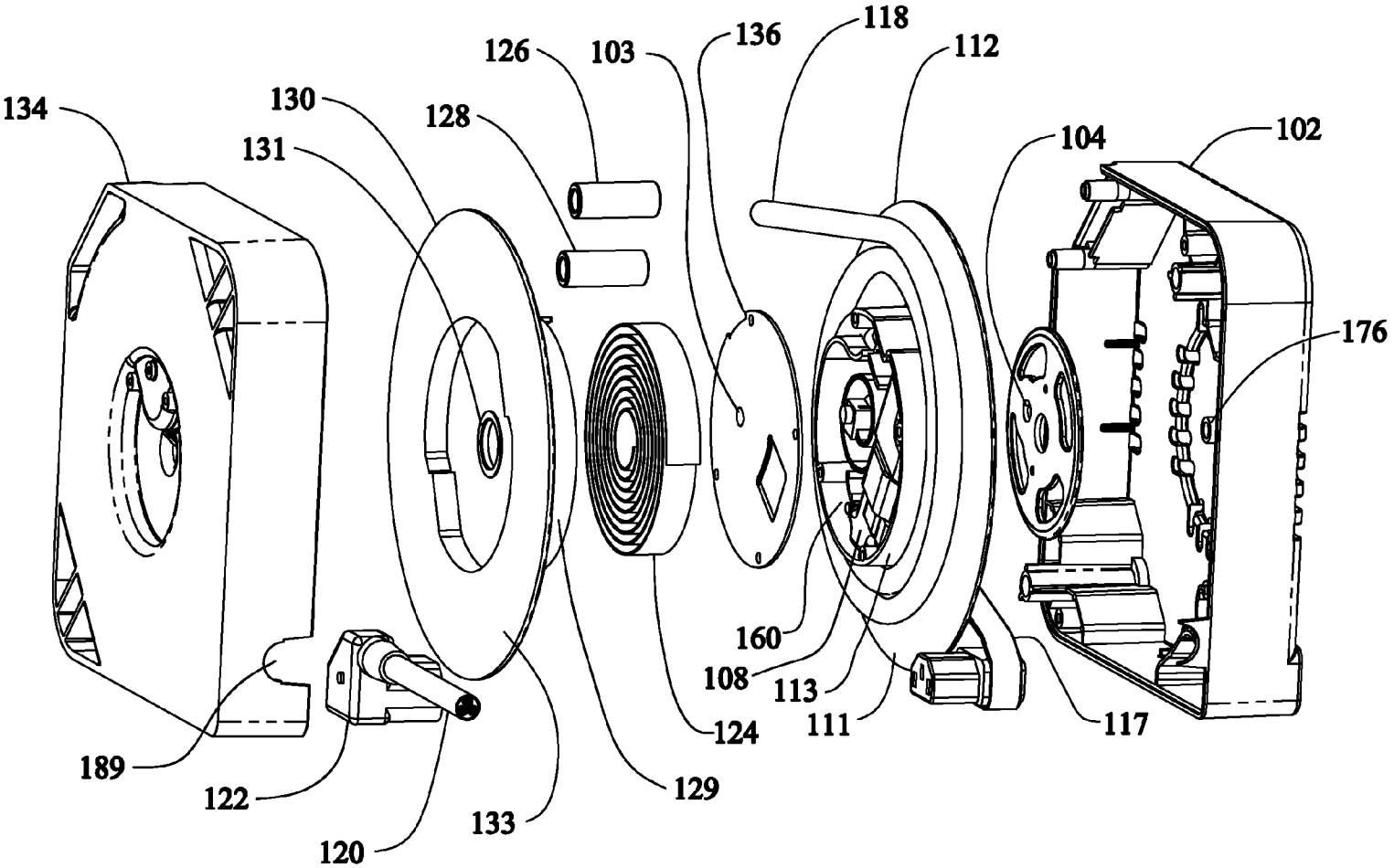
FIG. 1 is an exploded rear view of a cord reel assembly.
Figure 2:
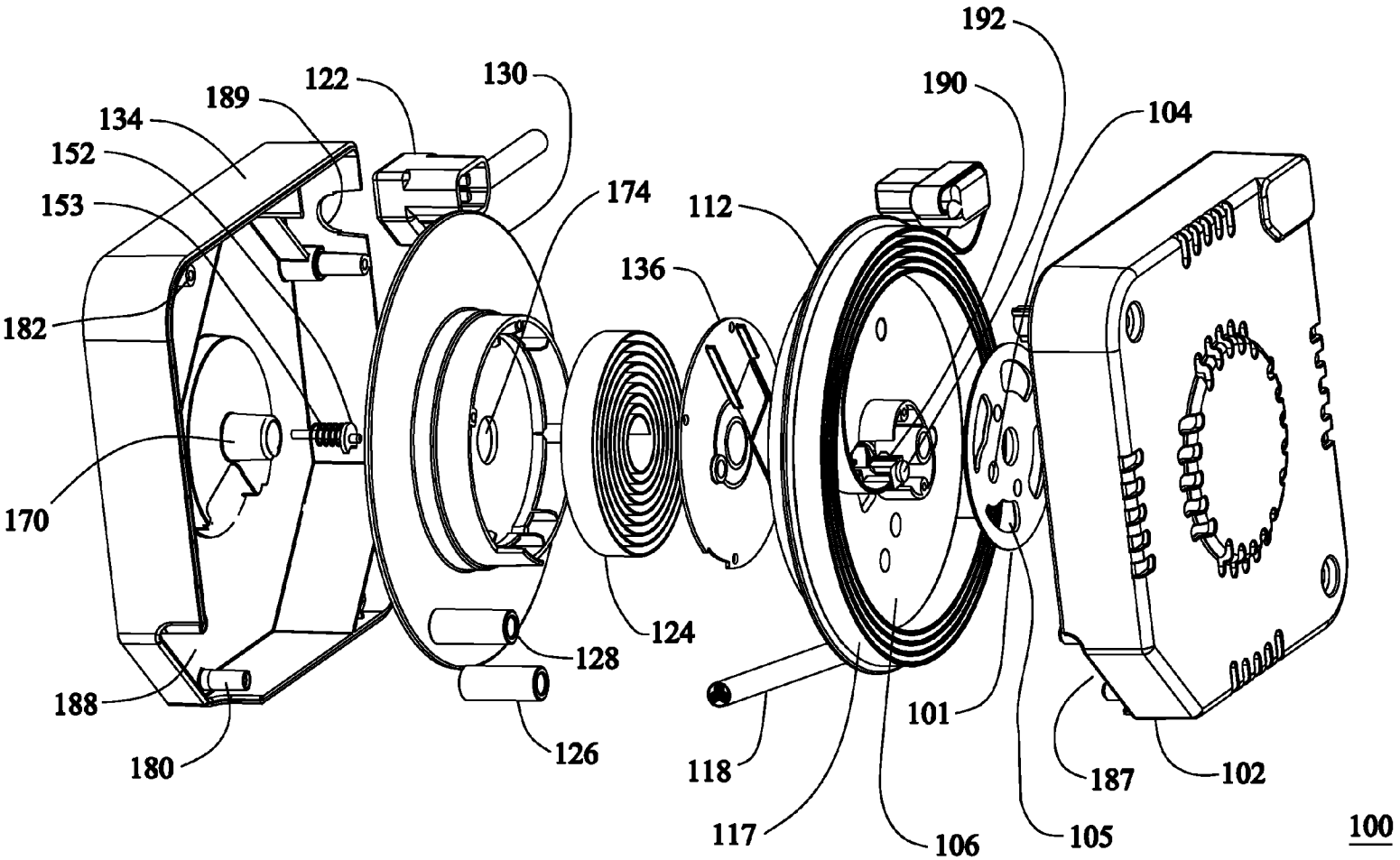
FIG. 2 is an exploded front view of a cord reel assembly of FIG. 1.

As can be seen in FIG. 1 and FIG. 2, the present invention comprises a retractable cord reel assembly from which a cord can be extended and retracted. The cord or cable could be a single or multiple conductor electrical cable that carries data, power or combination of electrical power and/or signals. The present invention can also be used to carry fluids such as hydraulics and pneumatics.

The present invention consists of rotating spool assembly consisting of a portion that carries a mostly round retractable cord, a portion that carries a coil of flat expandable cable, and has an internal chamber where the round cord and flat cable are connected. The rotating spool assembly can be installed in a housing with a cover as an independent cord reel assembly as depicted in FIG. 1, or it can be contained in a larger and more complex product, the housing formed as part of the larger product in which the spool is contained. The spool assembly is arranged for rotation in the housing and has some means of retracting the round cord such as a crank, motor, or spring as shown in FIG. 1.

Overview of Retractable Cord Assembly

Figure 3:
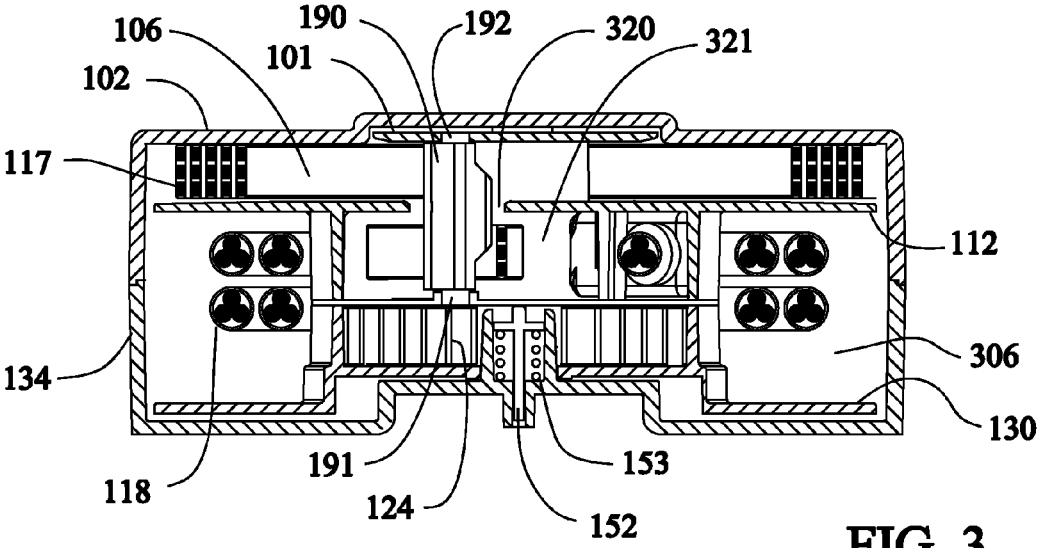
FIG. 3 is a cross section view of a cord reel assembly of FIG. 1 and FIG. 2.

FIG. 1, the present invention comprises a retractable cord reel assembly 100 for managing and organizing a retractable cord 118. The description for FIGS. 1-3 are similar to the teachings of the '763 to provide background and context for the prior art rotatable reel assemblies. The cord 118 could be a data line, a telephone line, an electric cable, or any other cable, and/or wire or combination thereof for which retraction into a housing could be desirable.

Figure 4:
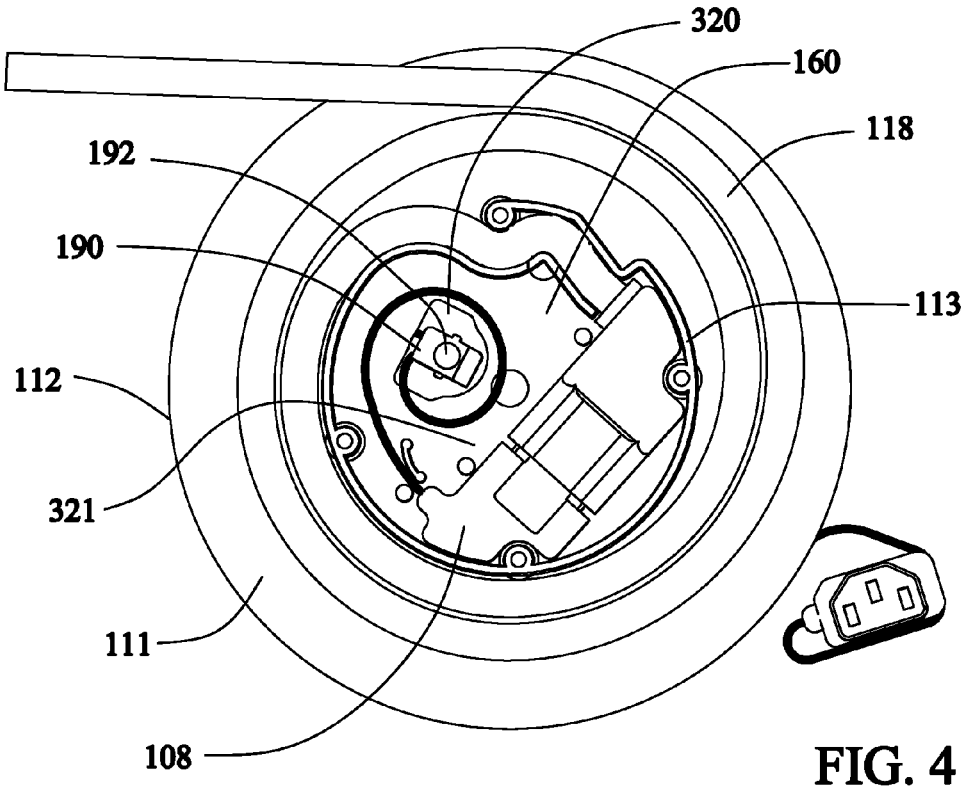
FIG. 4 is a view of the internal cavity of a spool assembly of FIG. 2.

Assembly 100 is illustratively configured such that the conductivity of retractable cord 118 is continuous with a stationary end 120. As set forth in detail below, assembly 100 is capable of many of these features due to cord 118 being connected to a flat cord 117 that is capable of expansion in an enclosed expansion chamber 106 while retractable cord 118 is withdrawn from assembly 100. In one example, the flat cable 117 illustratively comprises a plurality of conductive members arranged in a substantially parallel, side-by-side configuration. In another example the retractable cord 118 illustratively comprises a plurality of elongated, seamless conductive members, each having a conductor substantially covered by an insulating layer, the conductive members being positioned so as to form a round cord. The flat cord 117 can be made from pre-manufactured cord sets with an internal connector 108 as shown (see FIG. 8). In the example shown in FIGS. 1 and 2, the retractable cord reel assembly 100 comprises a spool 112, 130 for rotation about axis 131. Spool 112, 130 is disclosed as having a second or upper section 112 and a first or lower section 130. First section 112 comprises a cylindrical wall 113 coupled to a radial wall 111, and second section 130 comprises a cylindrical wall 129 coupled to a radial wall 133. FIG. 4 is a view of an internal cavity 160 formed by the cylindrical wall 113 coupled to a radial wall 111 of the first section. Spool 112, 130 may contain an internal radial wall 136 which in this example fits between spool portions 112 and 130 forming the lower wall of internal cavity 160. Internal wall 136 may have a pivot point 103 for rotatably mounting one end of rotatable guide 190.

Spool 112, 130 may also comprise a radial flange 101 with a pivot point 104 for rotatably mounting one end of a rotatable guide 190. Flange 101 functions in part to position and maintain flat cord 117 in flat cord expansion chamber 106 (see FIG. 3), defined also by radial wall 111.

Radial flange 101 may contain any number of ventilation holes 105, allowing the dissipation of heat originating from flat cord expansion chamber 106. Because flat cord 117 cannot be removed from its expansion chamber 106, it may be more susceptible to overheating in certain uses than retractable cord portion 118. Other walls and flanges may also comprise ventilation holes (not shown) to further dissipate heat.

As can be seen in FIGS. 1-3, cord reel assembly 100 illustratively comprises a housing base 134 configured for mounting on a wall or similar surface, and a housing cover 102 coupled to the housing base 134 and facing away from the wall or substrate on which the housing base 134 is mounted. As shown in FIG. 3, spool 112, 130 may be aligned within the housing base 134 such that flat cable 117 is nearer to the housing cover 102 than retractable cord retention chamber 306. This configuration allows greater dissipation of heat from flat cord expansion chamber 106, while still allowing sufficient dissipation of heat from cord retention chamber 306, due to the fact that at least part of retractable portion cord 118 may remain outside of housing 134 while in use.

The housing cover 102 and the housing base 134 may be fixed together via fasteners, such as screws, fastened through various holes 182 through the housing base 134 and finishing within the housing cover 102. In the center of the inside of the housing base 134 and substantially along axis 131 may be attached a base axle 170, a cylindrical appendage to be coupled to lower section 130. A spring 124 is also be added to connect axle 170 to lower section 130 in a manner that will bias the spool assembly to rotate and retract an extended cord. lower section 130 may possess an axle hole 174 to accept the housing base axle 170 allowing rotation of lower section 130 along axis 131 relative to the housing base 134. The housing cover 102 may possess a top axle 176, a similar cylindrical appendage to base axle 170, to enable the rotation of spool 112, 130 relative to the stationary housing 102, 134 of assembly 100. Alternatively, additional bearings may be also used.

The housing base 102 and the housing cover 134 illustratively possesses a hole 586 (visible in FIG. 16) axially aligned with and of similar or lesser width than cord retention chamber 306 for access to retractable cord 118. Hole 586 may be formed of an opening 187 in housing cover 102 and an opening 188 in housing base 134, bordered by cylindrical supports 180. Cylindrical supports 180 may be covered by rollers 126, 128 to facilitate the sliding of retractable cord 118 past hole 586 during withdrawal. Hole 189 in housing base 134 allows passage of stationary cord 120 (visible in FIG. 5) through housing 134. An internal portion of the stationary cord 120 includes a stationary cord internal connector 122 (see FIG. 7).

Figure 16:
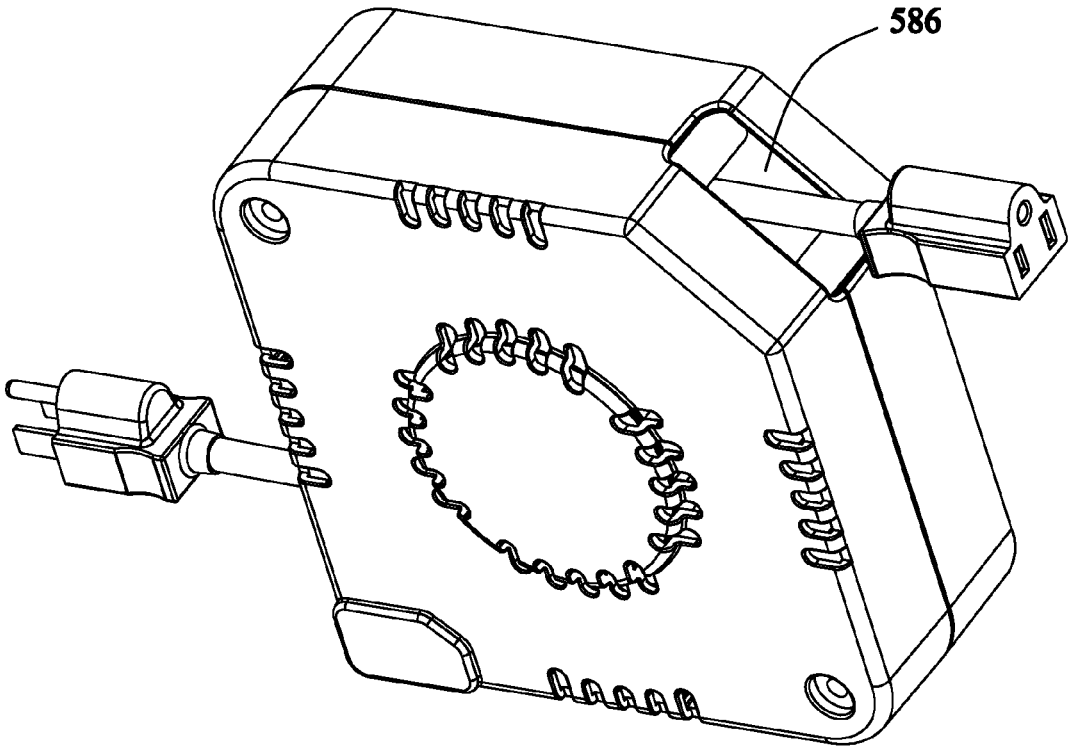
FIG. 16 is an assembled a cord reel of FIG. 1 and FIG. 2.

Unlike prior art retractable cord reels, there is no requirement to splice retractable cord 118 and flat cord 117. Rather each cord set can be formed with plugs and/or receptacles prior to assembly into the cord reel. An assembled cord reel of FIG. 1 and FIG. 2 is shown in FIG. 16.

Flat Cable Expansion Using Rotatable Guide

Figure 5:
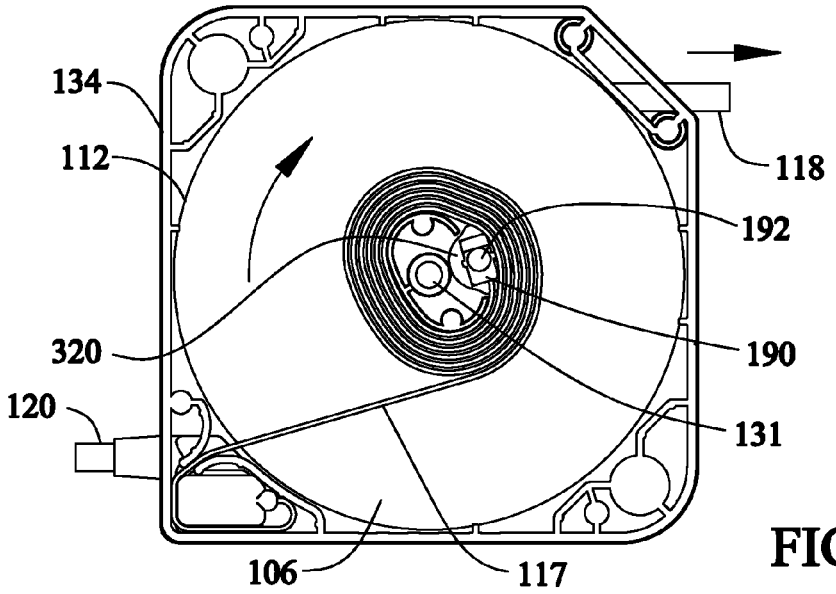
FIG. 5 and FIG. 6 are cross sectional views of the flat cable expansion chamber showing the sequence of the flat cable uncoiling and recoiling during extension of the retractable cord of FIG. 2.
Figure 6:
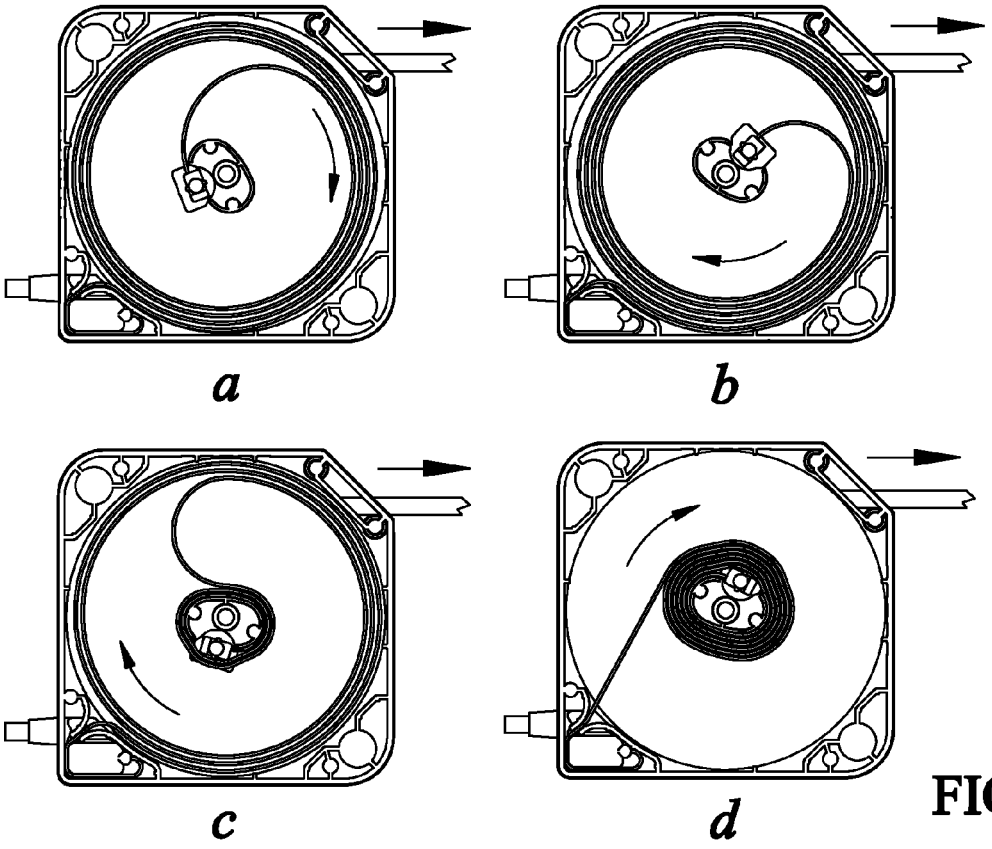

Turning to FIG. 5 and FIG. 6 shown are cross sectional views of the flat cable expansion chamber 106 showing the sequence of the flat cable 117 uncoiling and recoiling during extension of the retractable cord of FIG. 2. As the retractable cord 118 is extended from the cord reel, the spool rotates. At full retraction, the non-retractable flat cable is tightly coiled near the center axis 131 of spool 112 in a flat cable expansion chamber as shown in FIG. 5. As the retractable cord is extended, the rotation of the spool 112 causes the flat cable 117 to unwind and the coil of flat cable 117 to expand towards the perimeter of the expansion chamber shown in FIG. 6*a*. At about halfway to full extension the flat cable has fully unwound in the expansion chamber 106 and the coil is at the perimeter of the chamber. At this point, further rotation of the spool 112 causes the flat cable 117 to flip direction as shown in FIG. 6*b*. Once the flat cable 117 has flipped, further rotation causes the flat cable to coil on the spool hub in the opposite direction as shown in FIG. 6*c* until the retractable cord reaches full extension and the flat cable is once again coiled on the spool hub in a direction opposite that at full retraction as shown in FIG. 6*d*.

Near the spool hub a relatively flat rotatable guide 190 is rotatably connected to the spool assembly. The rotatable guide 190 guides the flat cable 117 from the flat cable expansion chamber 106, through an axial opening 320 in the radial wall of the spool 112 which separates the flat cable expansion chamber 106 and the interior of the spool 112, 130 as shown in FIG. 3. The spool interior contains an interconnection chamber 321 where the flat cable 117 is connected to the retractable/extendable cord 118. The rotatable guide 190 guides the flat cable 117 into the interconnection chamber 321 where the flat cable 117 forms a small coil around the rotatable guide 190 before it connects to the retractable cord 118. This small coil in the spool interior allows the rotatable guide 190 to rotate back and forth approximately 180 degrees as the flat cable 117 flips and changes direction in the expansion chamber avoiding any associated sharp bending of the flat cable 117 which might result in premature fatigue failure.

Two-Plane Rotatable Guide

As shown in FIG. 3 and FIG. 4, the rotatable guide 190 passes through the expansion chamber 106 through the spool wall, and mostly or entirely through the interconnection chamber 321 of the spool 112, 130. The rotatable guide 190 is rotatably supported at each end by the spool 112, 130 and does not contact the axial opening 320 in the spool. This arrangement allows the rotatable guide 190 to guide the flat cable 117 without contacting the radial wall separating the expansion chamber from the interconnection chamber. Since the rotatable guide 190 does not depend on the axial opening for bearing support, the axial opening can be made large enough to allow connectors on pre-manufactured cord sets to be routed through, eliminating the need to terminate the cords or cables after routing through the opening. This saves time during assembly and reduces the cost of terminating the cord.

Pre-Manufactured Cord Sets

Figure 7:
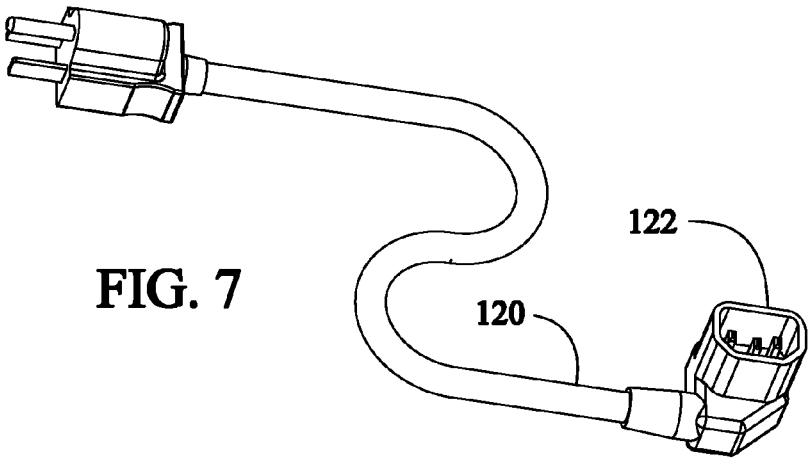
FIG. 7 is an example of a pre-manufactured stationary cord set to be installed in a cord reel.
Figure 8:
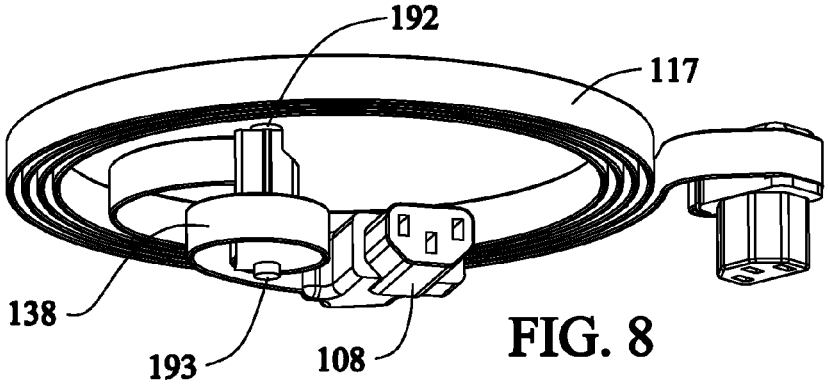
FIG. 8 is an example of pre-manufactured flat cable cord set to be installed in a cord reel with a rotatable guide attached.
Figure 9:
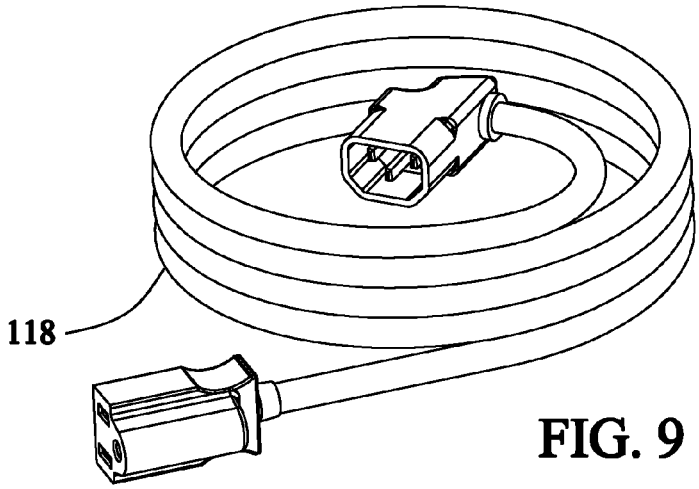
FIG. 9 is an example of pre-manufactured retractable cord set to be installed in a cord reel.

FIG. 7 is an example of a pre-manufactured stationary cord set. FIG. 8 shows an example of a pre-manufactured flat cable cord set with molded connectors on each end, and a rotatable guide 190 attached to the cable and FIG. 9 is an example of a pre-manufactured retractable cord set.

The spool interior includes an interconnection chamber where the flat cable is connected to the round retractable cord. This connection can be of any conventional means such as crimp connections, pins and sockets, screws, solder or other common means. In this example connectors are molded on the cables or cords that allow them to be simply plugged together using pre-manufactured cord sets as shown in FIGS. 7-9. These connectors can be of a standardized UL recognized configuration or a custom design. The connectors can be overlapping as shown in FIG. 1 and FIG. 2 allowing a sealant or adhesive to be applied to make the connection permanent and environmentally sealed. The connectors can also be designed to mechanically form an environmental seal without the need for adhesive or sealants. Once the round extendable cord is connected to the flat cable, it is routed out of the interconnection chamber where it winds on the spool and ultimately exits the cord reel for connection to a power source or device.

At the perimeter of the flat cable expansion chamber, the flat cable is secured to the housing where it may be connected to another round cord that exits the housing. While in many cases it would be acceptable to simply route the flat cable out of the housing for termination to a device or power source, in some cases it is preferable to have a more rugged, jacketed cord external to the housing. In this case, the outer connector on the flat cable is plugged to a round cord which exits the housing.

An alternative to connectors on the end of each cord or cable is to splice the conductors of the cords and cables and use molded polymer to cover, insulate and seal the connection. Also known as over molding, polymer plastic or elastomer is molded over the spliced conductors providing a permanently insulated and sealed connection. This process can be done at a specialized facility that produces a single, unified pre-manufactured cable assembly comprising of flat cable and round cord sections spliced, insulated, sealed and ready for assembly into a cord reel. The large axial opening 320 in the radial wall of the spool, made possible by the rotating rotatable guide 190, allows the over molded connections to be routed through an adequately sized opening for easy assembly.

An alternative to over-molding is to insulate the splice with a potting compound such as silicone or epoxy. The potting compound can be cast around the splice, and the resulting insulated and sealed splice can be routed through the axial opening in the spool wall allowing for easy assembly to the cord reel. This potting compound alternative can be applied to any or all of the splices in the cord reel.

The result of the sealed connections in this example is a cord reel that is environmentally sealed such that it can be used in wet or hazardous environments because there is no potential for exposed conductors that may cause shock or fire. The insulated and sealed cord sets or unified cord assembly can be routed through the spool and installed in the cord reel thanks to the large axial opening in the spool made possible by the rotating rotatable guide.

Rotatable Guide Examples

Figure 10:
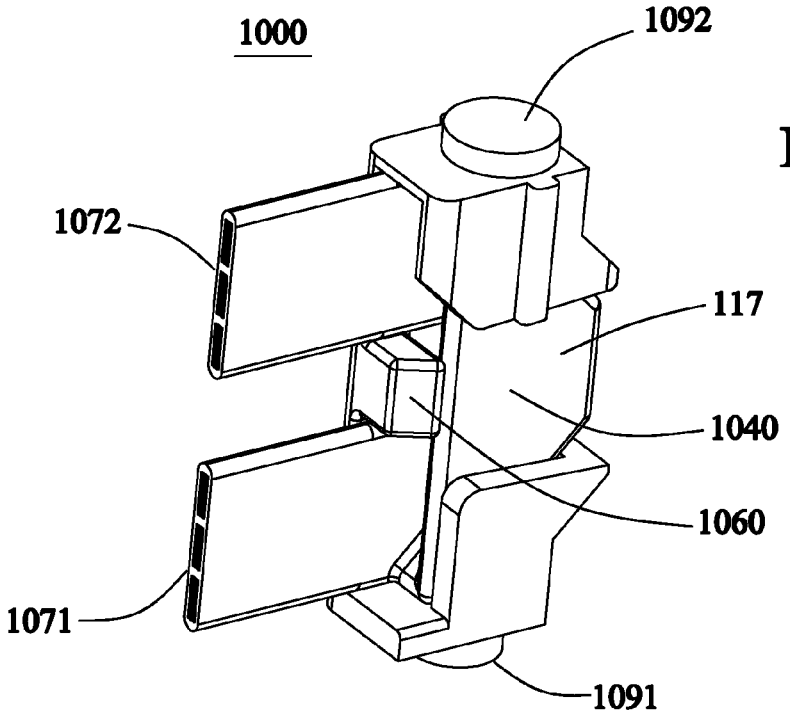
FIG. 10 is a first example of a rotatable guide shown with a portion of a flat cable installed.

Turning now to FIG. 10 illustrated is a first example of a rotatable guide with a portion of a flat cable installed. In this example shown is a substantially C-shaped rotatable guide 1000. There are two potions of the flat cable 117 as shown. An upper portion 1072 of flat cable 117 enters into the substantially C-shaped guide at an upper plane and a lower portion 1071 exits at a lower plane as shown. A fastening means 1060, such as a pin, a screw, a rivet, adhesive, a tab, rib, or a combination thereof, is used to hold the flat cable 117 within the substantially C-shaped rotatable guide 1000. A lower pivot point 1091 and upper pivot point 1092 formed on each end of the substantially C-shaped rotatable guide 1000 is shown. The lower and upper pivot points 1091, 1092 are coaxially aligned and sized to be rotatably mounted in the spool 112, 130 as shown in FIG. 3. The C-shaped rotatable guide 1000 includes a slot 1040 formed in a side as shown to provide communications to the interior thereof. In one example, the rotatable guide 1000 can attach to a finished pre-manufactured cable as shown in FIG. 8. The flat cable 117 is typically folded and inserted into a rotatable guide 1000.

Figure 11:
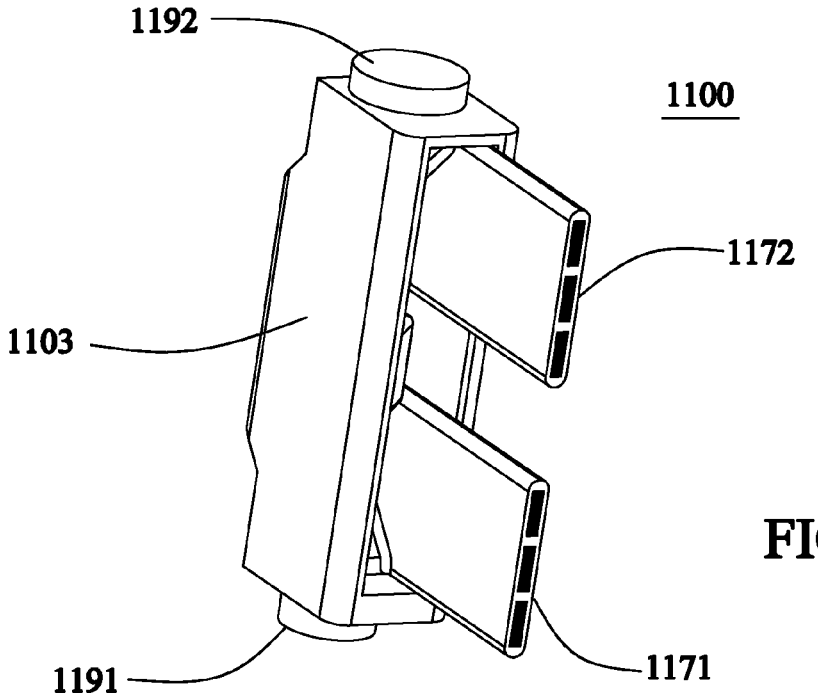
FIG. 11 is a second example of a rotatable guide shown with a portion of a flat cable installed.

FIG. 11 illustrated is a second example of a rotatable guide with a portion of a flat cable installed. In this example shown is a substantially rectangular shaped rotatable guide 1100. An upper portion 1172 of flat cable 117 enters into the substantially rectangular shaped guide at an upper plane and exits a lower portion 1171 at a lower plane as shown. A side cover 1103 holds the flat cable 117 within the substantially rectangular shaped rotatable guide 1100. A lower pivot point 1191 and upper pivot point 1192 formed on each end of the substantially rectangular shaped rotatable guide 1100 is shown. The lower and upper pivot points 1191, 1192 are coaxially aligned and sized to be mounted rotatably in the spool 112, 130 as shown in FIG. 3. In one example, the rotatable guide 1100 can attach to a finished pre-manufactured cable as shown in FIG. 8. The flat cable 117 is typically folded and inserted into a rotatable guide 1100.

Figure 12:
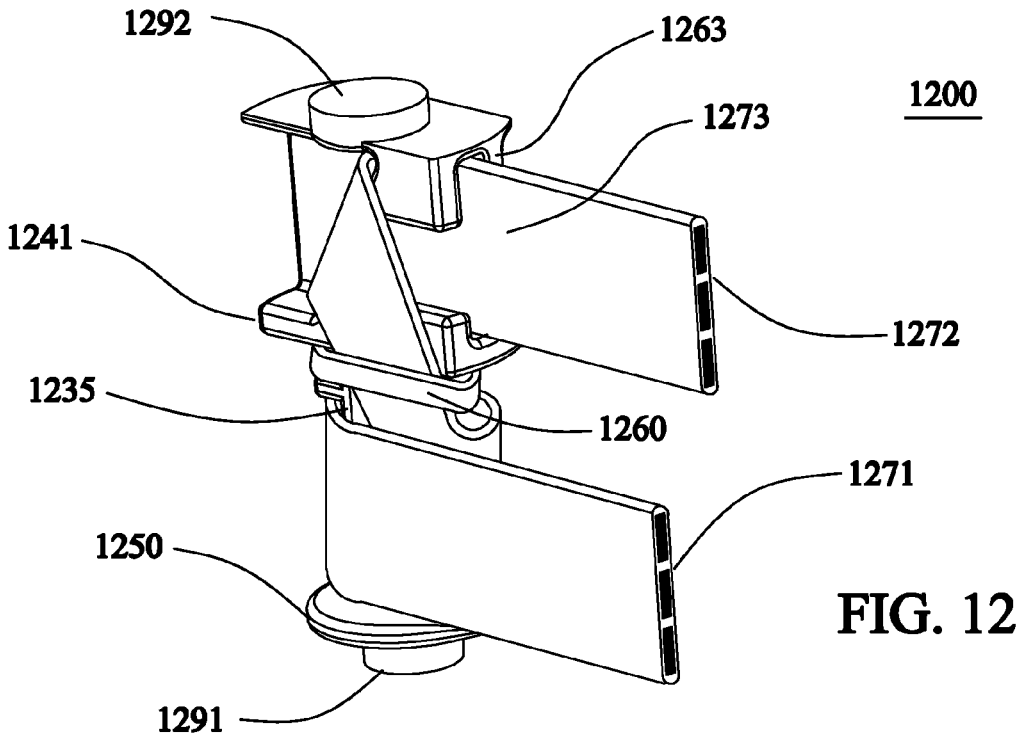
FIG. 12 is a third example of a rotatable guide shown with a portion of a flat cable installed.

FIG. 12 illustrated is a third example of a rotatable guide with a portion of a flat cable installed. In this example shown is a rotatable guide 1200 with two distinct portions. An upper portion 1272 of flat cable 117 enters into the substantially rectangular shaped portion 1263 at the upper plane at the side 1273. The flat cable 117 wraps around rod 1235 attached to a first portion 1241 of the substantially rectangular shaped portion 1263. A lower portion 1271 of the flat cable 117 exits at a lower plane as shown. A side retainer 1260 holds the flat cable 117 within the rotatable guide 1200. A lower pivot point 1291 and upper pivot point 1292 formed on each end of the rotatable guide 1200 is shown. The lower and upper pivot points 1291, 1292 are coaxially aligned and sized to be mounted rotatably in the spool 112, 130 as shown in FIG. 3. In one example, the rotatable guide 1200 can attach to a finished pre-manufactured cable as shown in FIG. 8. The flat cable 117 is typically folded and inserted into a rotatable guide 1200. A flange 1250 helps to guide flat cable 117 being wound around rod 1235.

Figure 13:
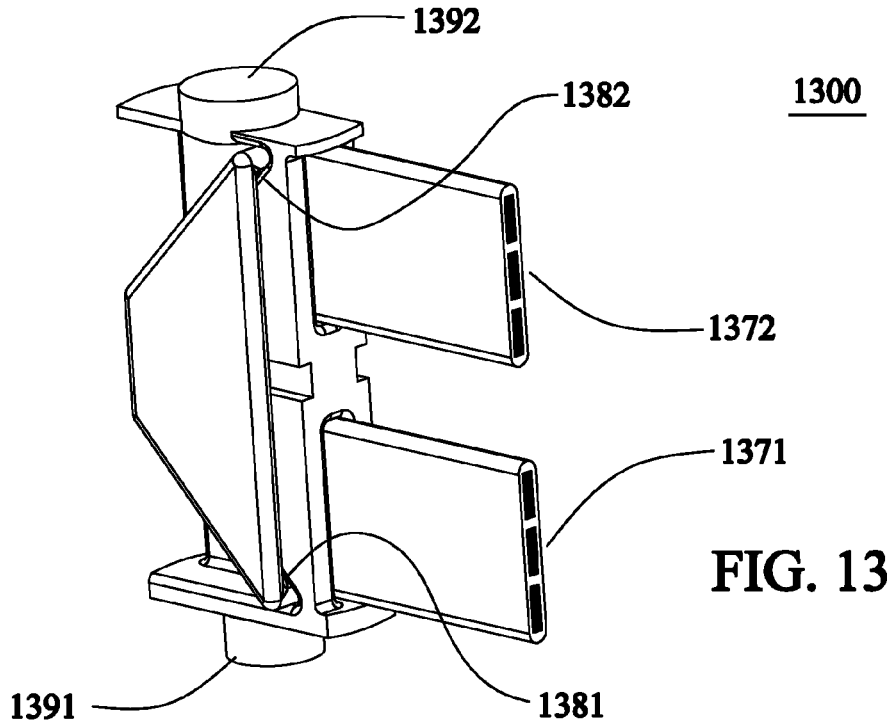
FIG. 13 is a fourth example of a rotatable guide shown with a portion of a flat cable installed.

FIG. 13 illustrated is a fourth example of a rotatable guide with a portion of a flat cable installed. In this example shown is a substantially rectangular shaped rotatable guide 1300. An upper portion 1372 of flat cable 117 enters into the substantially rectangular shaped guide at an upper plane and exits a lower portion 1371 at a lower plane as shown. Unlike rotatable guide 1100, there is no side cover. Rather the two side openings 1381 and 1382 are formed at approximately 90 degrees with respect to each other to hold the flat cable 117 within the substantially rectangular shaped rotatable guide 1300. A lower pivot point 1391 and upper pivot point 1392 formed on each end of the substantially rectangular shaped rotatable guide 1300 is shown. The lower and upper pivot points 1391, 1392 are coaxially aligned and sized to be mounted rotatably in the spool 112, 130 as shown in FIG. 3. In one example, the rotatable guide 1300 can attach to a finished pre-manufactured cable as shown in FIG. 8. The flat cable 117 is typically folded and inserted into a rotatable guide 1300.

Figure 14:
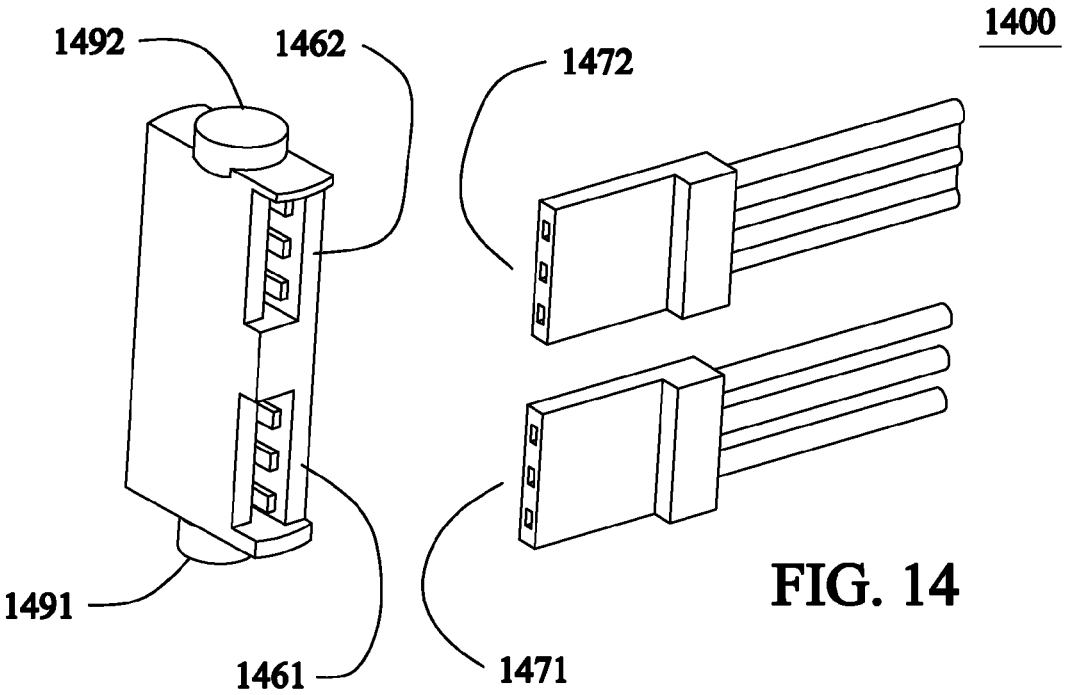
FIG. 14 and FIG. 15 are a fifth example of a rotatable guide with integral electrical connectors.
Figure 15:
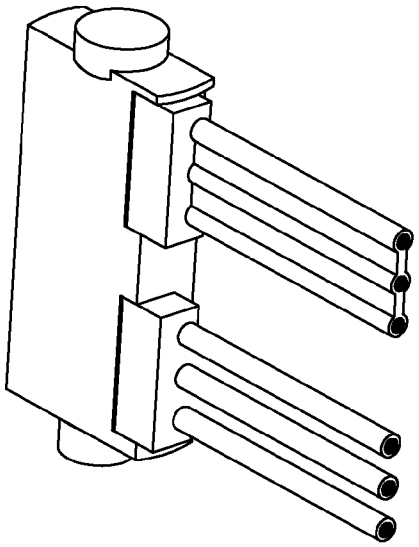

FIG. 14 and FIG. 15 illustrated is a fourth example of a rotatable guide with integral electrical connectors. In this example shown is a substantially rectangular shaped rotatable guide 1400. In this example an upper set of male contacts 1462 and lower set of male contacts 1461 are disposed in or integrated or molded into the substantially rectangular shaped rotatable guide 1400. Upper female cable contacts 1472 and lower female cable contacts 1471 are configured to electrically and mechanically couple with corresponding upper male contacts 1462 and lower male contacts 1461. As understood by those skilled in the art, the connector pairs 1461, 1471 and 1462, 1472 may be formed to be non-symmetrical to permit only a single orientation. Moreover, the different genders or types of plugs and receptacles may be used. A lower pivot point 1491 and upper pivot point 1492 formed on each end of the substantially rectangular shaped rotatable guide 1400 is shown. The lower and upper pivot points 1491, 1492 are coaxially aligned and sized to be mounted rotatably in the spool 112, 130 as shown in FIG. 3.

This "pluggable" rotatable guide alternative is particularly attractive in high volume miniature electronics as a multitude of options exist for integral rotatable guide connectors such as small circuit board connectors. One such option is a Zero Insertion Force (ZIF) connector which is a preferred method for terminating flat cables known as "laminated cables" that are insulated by thin sheets of polymer plastic.

In some applications, the cables may simply have crimped terminals on the conductors that are inserted directly into the rotatable guide connector. In some applications, it may be desirable to have a rotatable guide that accepts bare wire without any socket or pin terminal. Still, in other applications, insulation displacement terminations can be incorporated into the rotatable guide reducing or eliminating wire preparation before assembly.

While many of the pluggable rotatable guide applications may not need environmental seals, the connections of the cables to the rotatable guide can be sealed if desired. Mechanical seals can be incorporated to the cords and cables, or the connections can be insulated or potted with silicone, epoxy or other adhesives or sealants. Still in other cases, the connections to the rotatable guide can be over-molded, or the conductors can be molded directly to the rotatable guide itself.

Spool Biasing

Molded plastic is a common material used to manufacture cord reel housings, spools and components. Dimensional variations of the parts due to warping and shrinking must be accommodated. It is undesirable to have a spool fit too tightly or too loosely in the housing so a means to adjust axial clearance or endplay between the spool assembly and housing is desired. One common method is to use shims or washers of varying thickness, but this can be costly and time consuming. In this example a means of adjusting and minimizing endplay after assembly such as a plunger 152 shown in FIG. 2 and FIG. 3. Adjusting the axial location of the plunger would bias the spool assembly to remove endplay. One simple means would be to have an adjusting screw to push the plunger to the desired location. Since the adjusting screw is accessible from the housing exterior, the adjustment could be made after the cord reel is assembled. An alternative would be to add screw threads to the plunger thereby eliminating the need for a separate screw. An automatic means of removing endplay would be to add a spring behind the plunger which would bias the spool without need for manual adjustment.

Figure 17:
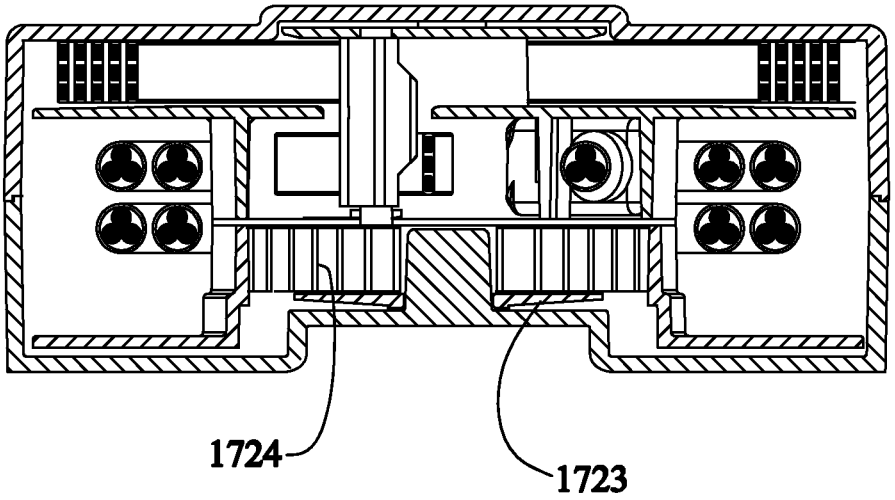
FIG. 17 is a section view of a cord reel of FIG. 2 with a power spring wound to provide axial biasing of the spool.

FIG. 17 is a section view of a cord reel of FIG. 2 with a power spring 1724 wound to provide axial biasing of the spool. This example uses an axially movable flange 1723 with a portion of the power spring configured to push against flange 1723, eliminating the need for a separate plunger 152 and plunger spring 153. Still another option is to use the natural tendency of a power spring to expand axially as it is tensions through rotation. Placing the power spring axially between the spool and housing would bias the spool as shown in FIG. 17. The axial biasing can be enhanced by winding the center of the spring such that it is axially displaced from the perimeter of the spring when it is in its natural condition. The natural condition of the resulting spring would have a somewhat conical shape.

Figure 18:
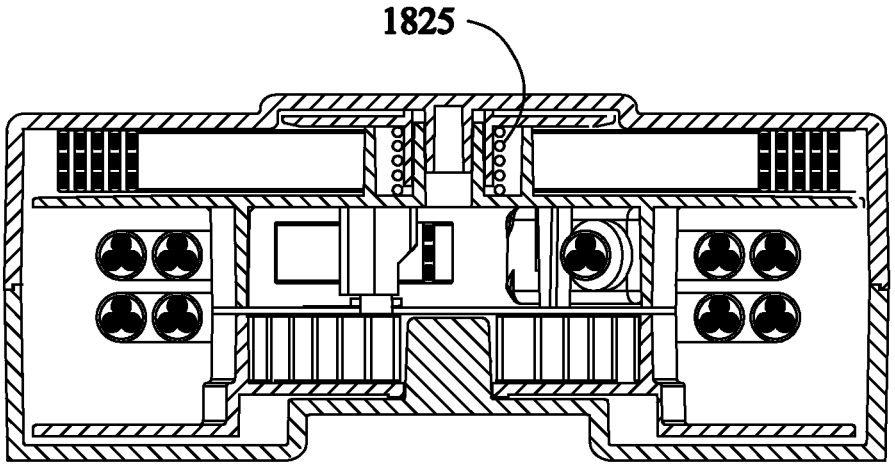
FIG. 18 is a section view of a cord reel of FIG. 2 with a axially movable spool flange.

An alternative to the plunger as described above is shown in FIG. 18. In this variation, the spool flange is configured to move axially and is biased away from the spool and towards the housing cover. This reduces or removes endplay as well as provides the desired axial alignment of the spool flange to the inside of the housing cover. FIG. 18 shows the spool flange as being biased by a spring 1825 which provides automatic removal of endplay. As can be easily understood by those skilled in the art, the spring 1825 can be substituted with a screw or similar mechanism to adjust endplay in a manner similar to the plunger described above. Such an adjustment mechanism could be accessed through a small hole in the housing or housing cover and adjusted after the cord reel is assembled.

Non-Limiting Examples

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A rotatable guide for use with a flat cable in a retractable cord reel apparatus, the rotatable guide comprising:

a substantially C-shaped body;

a first pivot point disposed on a first end of the substantially C-shaped body; and a second pivot point disposed on a second end of the substantially C-shaped body and co-axially aligned with the first pivot point, the substantially C-shaped body formed to guide a flat cable to enter the substantially C-shaped body in a first plane and guide the flat cable to exit in a second plane that is parallel to the first plane and perpendicular to an axis of rotation of the first pivot and the second pivot.

2. The rotatable guide of claim 1, further comprising:

a fastening means for holding a flat cable therein and with two ends of the flat cable exiting therefrom.

3. The rotatable guide of claim 2, wherein the fastening means is at least one of a pin, a screw, a rivet, adhesive, a tab, rib, or a combination thereof.

4. A rotatable guide for use with a flat cable in a retractable cord reel apparatus, the rotatable guide comprising:

an elongated body having a first substantially rectangular opening formed therein and configured to be an entrance for a flat cable to pass therethrough and having a second substantially rectangular opening formed therein and configured to be an exit for the flat cable to pass therefrom;

a first pivot point disposed on a first end of the elongated body; and a second pivot point disposed on a second end of the elongated body and co-axially aligned with the first pivot point, the elongated body formed to guide a flat cable to enter the elongated body in a first plane and guide the flat cable to exit in a second plane that is parallel to the first plane and perpendicular to an axis of rotation of the first pivot and the second pivot.

5. The rotatable guide of claim 4, wherein at least one of the first substantially rectangular opening and the second substantially rectangular opening are generally aligned with an axis of the first pivot point and second pivot point.

6. The rotatable guide of claim 5, wherein the first substantially rectangular opening and the second substantially rectangular opening are oriented one over the other and at least one is generally aligned with the axis of the pivots.

7. The rotatable guide of claim 4, wherein the elongated body includes having the first rectangular opening and the second rectangular opening located on a same side of the elongated body.

8. The rotatable guide of claim 4, wherein the elongated body includes having the first substantially rectangular opening and the second substantially rectangular opening combined to form a single elongated opening located on a same side of the elongated body.

9. The rotatable guide of claim 4, wherein at least one of the first substantially rectangular opening and the second substantially rectangular opening are substantially in a radial direction.

10. The rotatable guide of claim 4, wherein the elongated body is substantially rectangular in shape.

11. The rotatable guide of claim 4, wherein the elongated body includes having a slot through one side in communication with the first rectangular opening and the second rectangular opening.

12. The rotatable guide of claim 4, wherein the elongated body includes an interior cavity in communication with the first substantially rectangular opening and the second substantially rectangular opening.

13. The rotatable guide of claim 4, wherein the elongated body includes a tab separating the first rectangular opening and the second rectangular opening.

14. The rotatable guide of claim 4, wherein the first pivot point is cylindrical shaped and the second pivot point is cylindrical shaped.

15. The rotatable guide of claim 4, further comprising:

a connector disposed within at least one of the first substantially rectangular opening and the second substantially rectangular opening.

16. The rotatable guide of claim 15, wherein the connector includes male contacts.

17. The rotatable guide of claim 15, wherein the connector includes non-symmetrical portions in order for contacts with a first gender to electrically couple with a corresponding contacts of a second gender in a corresponding connector in only a single orientation.

18. A retractable cord reel comprising:

a housing with an interior and an exterior;

a spool with an axis arranged for rotation relative to the housing, the spool is axially divided into a plurality of chambers, and the spool including a set of pivot points;

an elongated body consisting of a first portion configured as an entrance for a flat cable in a first plane and a second portion configured as an exit for the flat cable in a second plane that is parallel to the first plane, a first pivot point disposed on a first end of the elongated body and a second pivot point disposed on a second end of the elongated body and co-axially aligned with the first pivot point, the elongated body rotatably mounted between the set of pivot points in the spool; and a cord traversing the interior of the housing and terminating in retractable and stationary ends external to the housing.

19. The retractable cord reel of claim 18 wherein the elongated body is supported by pivot points in the spool located at the distal ends of adjacent chambers.

20. A rotatable guide for use with a flat cable in a retractable cord reel apparatus, the rotatable guide comprising:

an elongated body consisting of a first portion configured as an entrance for a flat cable and a second portion configured as an exit for the flat cable, at least one of the first portion and the second portion formed as a substantially rod-shaped portion;

a first pivot point disposed on a distal end of the first portion of the elongated body;

a second pivot point disposed on the distal end of a second portion of the elongated body; and a flange formed between the rod-shaped portion and one of the first pivot point and the second pivot point.

21. The rotatable guide of claim 20 wherein the flange extends for less than 180 degrees around the rod-shaped portion of the guide.

22. The rotatable guide of claim 20 wherein the flange further includes an outer periphery and a lip disposed thereon extending in a direction of the first portion of the rotatable guide.

23. The rotatable guide of claim 20 wherein the rod shaped portion has a cross section that is one of non-circular, C-shaped, T-shaped, X-shaped; and cross-shaped.

* * * * *